United States Patent [19]

Rhees

[11] Patent Number: 4,555,037

[45] Date of Patent: Nov. 26, 1985

[54] TAMPER EVIDENT INNER SEAL FOR CONTAINERS

[76] Inventor: John T. Rhees, 795 Southampton, Farmington, Utah 84025

[21] Appl. No.: 618,073

[22] Filed: Jun. 7, 1984

[51] Int. Cl.[4] ..... B65D 23/00

[52] U.S. Cl. ..... 215/232; 215/250; 215/253; 215/256; 220/258

[58] Field of Search ..... 215/232, 230, 246, 250, 215/341, 253, 256; 220/258, 276

[56] References Cited

U.S. PATENT DOCUMENTS

| | | | |
|---|---|---|---|
| 2,102,440 | 12/1937 | Sebell | 215/253 X |
| 2,388,738 | 11/1945 | Gudheim | 215/232 |
| 3,501,042 | 3/1970 | Risch et al. | 215/232 |
| 3,640,417 | 2/1972 | Sakurai | 215/246 |
| 3,900,125 | 8/1975 | Wyler et al. | 215/341 |
| 3,984,005 | 10/1976 | Amber | 215/230 |

*Primary Examiner*—Steven M. Pollard

*Attorney, Agent, or Firm*—Thorpe, North & Western

[57] ABSTRACT

An inner seal for a container which has a hollow body for holding material, a threaded neck extending from the body to terminate in a lip which defines an opening, and a threaded cap for screwing onto the neck over the opening. The seal is comprised of a thin sheet of fracturable material for placement over the opening onto the lip. The peripheral portions of the material extend downwardly about and adhere to the exterior of the side walls of the neck. The seal is dimensioned to cover some of the threads of the neck so that screwing the cap onto the neck will aid in securing the seal about the side walls of the neck.

17 Claims, 2 Drawing Figures

TAMPER EVIDENT INNER SEAL FOR CONTAINERS

BACKGROUND OF THE INVENTION

This invention relates to a tamper-evident seal for use under the caps of bottles and the like.

A variety of "tamper-resistant" or "tamper-proof" bottles and bottle caps have been proposed for inhibiting improper and unauthorized opening of bottles containing medicines, foods, etc., or at least for making apparent to an observer that such opening has occurred. The reason for this, of course, is to protect purchasers against third parties tampering with bottle contents by placing such purchasers on notice that such tampering has occurred.

One common method of inhibiting tampering with the contents of a bottle is to place a foil seal over the bottle opening under the cap. This arrangement has been fairly effective against casual tampering since it is difficult to remove a foil seal without tearing or breaking the seal and any attempt to replace the seal would be reasonably evident. However, the seals in present use fit just over the bottle opening with no part of the seal extending downwardly about the sides of the bottle neck. Thus, if extra care were exercised, the seal can be peeled off the bottle opening for example by appropriate use of a razor blade or other similar instrument, to allow access to the interior of the bottle, and then the foil seal carefully replaced so that there is little evidence that tampering has occurred.

Of course, there are a number of other arrangements for providing tamper-resistant bottles or bottle caps including use of a film which is heat shrunk over the bottle top and cap. This approach does provide a readily observable indication as to whether or not tampering with the bottle has occurred, but the heat shrunk film is quite unattractive and makes it difficult for stacking the bottles or containers on which the film is placed.

Another approach for discouraging tampering is to place a shrink band about the bottle and cap so that the band overlaps the lower portion of a cap and the neck of the bottle just below the cap. It has been found, however, that such shrink bands may be removed and replaced fairly easily without leaving visible signs that the bottle has been tampered with.

Examples of prior art tamper-resistant arrangements are disclosed in U.S. Pat. Nos. 3,733,002, 3,459,322, 3,615,714 and 3,088,830.

SUMMARY OF THE INVENTION

It is an object of the invention to provide a simple, easy to install tamper-evident inner seal for bottles and the like.

It is another object of the invention to provide such a seal which cannot be readily removed and replaced without tearing or breaking to provide visual evidence of tampering.

It is a further object of the invention to provide a combination container and inner seal which is highly tamper resistant.

The above and other objects of the invention are realized in a specific illustrative embodiment of a tamper-evident seal for use on a container which includes a hollow body for holding material, a neck at one end circumscribing an opening through which material is inserted into and retrieved from the container, and a cap for placement over the opening onto the neck. The seal includes a sheet of material secured over the opening of the container, with the peripheral portions of the material extending downwardly about and adhering to the exterior of the side walls of the neck.

In accordance with one aspect of the invention, the sheet of material placed over the container opening incudes perforations formed generally to circumscribe the opening of the container to weaken the material at the location of the perforations. With the sheet of material extending down the sides of the neck of the container, and the provision of the perforations, it is extremely difficult to remove the material without breaking or tearing it.

BRIEF DESCRIPTION OF THE DRAWING

The above and other objects, features and advantages of the invention will become apparent from a consideration of the following detailed description presented in connection with accompanying drawings in which.

DETAILED DESCRIPTION

Figure 1:
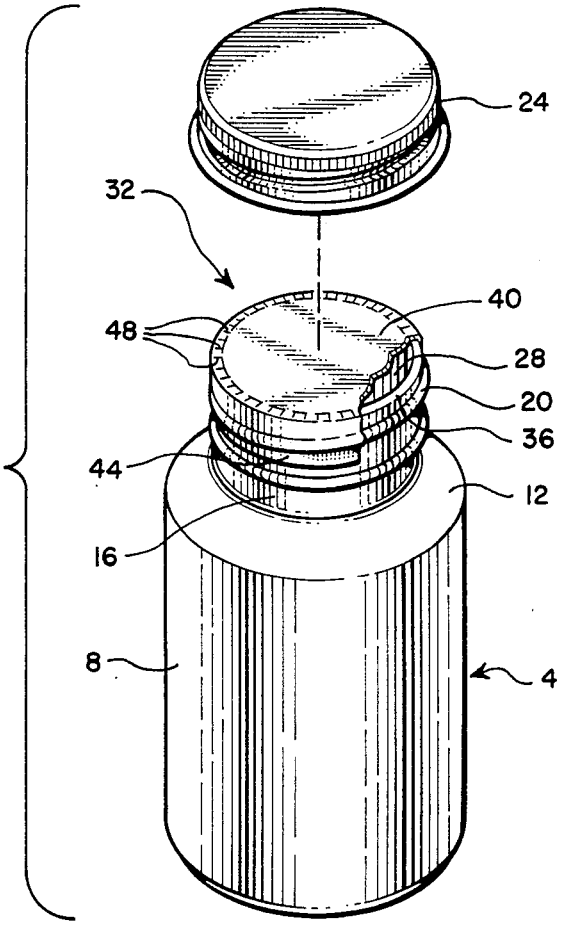
FIG. 1 shows a perspective, partially exploded view of a seal made in accordance with the principles of the present invention.

Referring to FIG. 1, there is shown a conventional bottle 4 having a hollow enlarged portion 8 for holding material, a shoulder portion 12 located above the enlarged portion 8, and a neck portion 16 which extends upwardly to terminate in a lip 36 and which includes threads 20 located on the exterior of the neck portion and onto which a conventional cap 24 may be screwed. The walls of the neck 16 circumscribe and define a throat and opening 28 through which material may be placed in and retrieved from the bottle.

The seal of the present invention comprises a sheet of material 32, preferably constructed of a fracturable material such as paper, foil, polystyrene foam, polypropylene, or the like. The material 32 is placed over the opening 28 of the bottle 4 and into contact with the lip 36. Advantageously, the sheet of material 32 includes a pressure sensitive adhesive on the underside so that when the sheet is placed in contact with the lip 36, it will adhere thereto.

Figure 2:
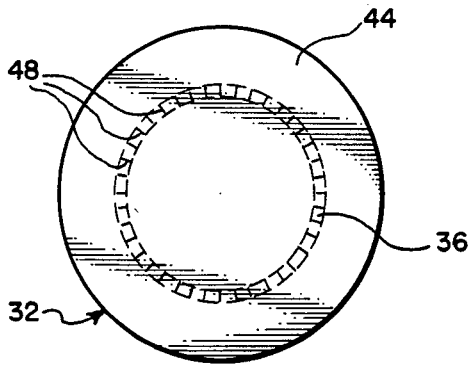
FIG. 2 shows a top view of the seal before it is placed on a container.

The sheet of material 32 is configured, for example, in a circular pattern as shown in FIG. 2, so that the periphery thereof extends beyond the lip 36 of the neck 16, i.e., so that the circumference of the sheet is greater than the circumference of the opening 28. The sheet of material 32 thus fits over the opening 28 and lip 36, and downwardly over the exterior side walls of the neck and over at least some of the threads 20 formed on the neck. The material 32 would be selected to be sufficiently thin to enable screwing the cap 24 onto the threads 20 after the material was placed over the threads. Screwing the cap 24 onto the threads 20 would aid in further securing the sheet of material 32 about the side walls of the neck 16.

Although the sheet of material 32 advantageously would be comprised of a fracturable material to allow tearing or breaking for entry into the interior of the bottle 4, a plurality of perforations 48 could be formed in the material to circumscribe the opening of the bottle, positioned generally above the lip 36 of the neck 16, to weaken the material at the location of the perforations and thereby make it easier to break or tear the material for entry into the bottle. Also, and more importantly, the perforations would lend to a breaking apart of the material if tampering were attempted. For example, any attempt to peel the seal from the bottle would likely cause the material to tear at the perforations so that it could not later be replaced to avoid detection of tampering. Of course, extending the material down over the sides of the neck 16 and over the threads 20 increases even further the difficulty of removing the seal by razor blade or other means without tearing or breaking the material. The perforations 48 shown in the drawings are formed to extend generally radially outwardly over the lip 36 of the bottle and this pattern is very simple to emboss or form on the material. Score marks or knurled patterns could be provided as an alternative to the perforations for weakening the sheet of material 32.

With the seal arrangement described above, a superior tamper-evident container can be provided. The sizing of the sheet of material 32 to extend downwardly over the side walls of the neck 16 and the provision of perforation or score marks 48 combine to present a seal which will readily tear or break if an attempt is made to remove the seal.

It is to be understood that the above-described arrangements are only illustrative of the principles of the present invention. Numerous modifications and alternative arrangements may be devised by those skilled in the art without departing from the spirit and scope of the present invention and the appended claims are intended to cover such modifications and arrangements.

What is claimed is:

1. A tamper-evident seal for use on a container which includes a hollow body for holding material, a neck at one end extending from the body to terminate in a lip and circumscribing an opening through which material is inserted into and retrieved from the container, and a cap for placement over the opening onto the neck, said seal comprising a sheet of material secured over the opening of the container onto the lip, with the peripheral portions of the material extending downwardly about and adhering to the exterior of the side walls of the neck, said sheet of material being weakened at locations generally over the lip of the container.

2. A seal as in claim 1 wherein said sheet of material includes perforations formed therein at locations generally over the lip to weaken the material at the location of the perforations.

3. A seal as in claim 2 wherein said perforations comprise a series of generally radially extending perforations.

4. A seal as in claim 1 wherein said sheet of material includes score marks formed therein at locations generally over the lip to weaken the material at the location of the score marks.

5. A seal as in claim 1 wherein said sheet of material includes knurled patterns formed therein at locations generally over the lip to weaken the material at the location of the knurled patterns.

6. A seal as in claim 1 wherein said sheet of material is secured to the lip and to the side walls of the neck by an adhesive.

7. A seal as in claim 1 wherein said sheet of material is comprised of a fracturable material.

8. A seal as in claim 7 wherein said sheet of material is comprised of a pressure sensitive adhesive material.

9. A seal as in claim 8 wherein said sheet of material is comprised of a polystyrene foam material.

10. A seal as in claim 8 wherein said sheet of material is comprised of polypropylene.

11. A seal as in claim 1 wherein the neck of the container includes threads on the side exterior thereof, wherein the cap includes threads on the interior thereof to enable screwing the cap onto the neck, and wherein said sheet of material is dimensioned to extend downwardly over at least a portion of the threads on the neck for securement thereover.

12. A method of sealing a container which includes a hollow body, an annular wall extending upwardly from the body and formed to define an opening and throat leading to the interior of the body, and a cap for placement over the opening, said method including placing a sheet of material over the opening to cover the opening, with the sheet sized to extend beyond the periphery of the opening, securing the sheet over the opening so that the edges of the sheet extend downwardly to adhere to the exterior of the annular wall, and weakening the sheet of material generally at locations circumscribing the opening of the container.

13. A method as in claim 12 wherein said weakening step includes the step of perforating or scoring the sheet of material at a locus of points generally circumscribing the opening of the container.

14. A method as in claim 13 wherein said placing and securing steps comprise placing and securing a sheet of fracturable material over the opening of the container and down the exterior of the annular wall.

15. A method as in claim 14 wherein said perforating step comprises forming generally radially extending perforations or score marks on the sheet of material to generally coincide with the top of the annular wall.

16. A method as in claim 12 wherein the exterior of the annular wall of the container is threaded and the cap is likewise threaded for screwing onto the annular wall, and wherein said placing and securing steps comprise placing and securing the sheet of material over the opening of the container and down over at least some of the threads of the annular wall.

17. In combination, a tamper-evident container and seal, with the container comprising a hollow body for holding material, a neck extending from the body to terminate in a lip, said neck defining an opening and thoat through which material may be inserted into and retrieved from the container, and a cap for placement over the opening onto the neck, and with the seal comprising a sheet of material secured over the opening of the container onto the lip so that the peripheral portions of the material extends downwardly about and adheres to the exterior of the side walls of the neck, said sheet of material including weakened portions located generally over the lip of the hollow body.

* * * * *